US012188204B2

(12) United States Patent
Hagiwara et al.

(10) Patent No.: US 12,188,204 B2
(45) Date of Patent: Jan. 7, 2025

(54) WORK MACHINE

(71) Applicant: HITACHI CONSTRUCTION MACHINERY CO., LTD., Tokyo (JP)

(72) Inventors: Naoki Hagiwara, Kasumigaura (JP); Kazuhiko Mizoguchi, Ishioka (JP); Keiichirou Anahara, Kasumigaura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 310 days.

(21) Appl. No.: 17/641,529

(22) PCT Filed: Oct. 28, 2020

(86) PCT No.: PCT/JP2020/040512

§ 371 (c)(1),
(2) Date: Mar. 9, 2022

(87) PCT Pub. No.: WO2021/085503

PCT Pub. Date: May 6, 2021

(65) Prior Publication Data

US 2022/0333345 A1 Oct. 20, 2022

(30) Foreign Application Priority Data

Oct. 31, 2019 (JP) ..... 2019-199405

(51) Int. Cl.
*E02F 9/20* (2006.01)
*E02F 9/24* (2006.01)
(Continued)

(52) U.S. Cl.
CPC ..... *E02F 9/2033* (2013.01); *E02F 9/24* (2013.01); *E02F 9/261* (2013.01); *E02F 9/262* (2013.01);
(Continued)

(58) Field of Classification Search
CPC ..... E02F 3/435; E02F 9/2033; E02F 9/2225; E02F 9/2285; E02F 9/2292; E02F 9/2296; E02F 9/24; E02F 9/261; E02F 9/262
See application file for complete search history.

(56) References Cited

U.S. PATENT DOCUMENTS 5,198,800 A 3/1993 Tozawa et al.
2013/0088593 A1* 4/2013 Ishimoto ..... E02F 9/226 348/143
(Continued)

FOREIGN PATENT DOCUMENTS

CN 109563693 A 4/2019
JP 4-52330 A 2/1992
(Continued)

OTHER PUBLICATIONS

Extended European Search Report received in corresponding European Application No. 20882962.2 dated Aug. 7, 2023.
(Continued)

*Primary Examiner* — Dale Moyer
(74) *Attorney, Agent, or Firm* — MATTINGLY & MALUR, PC

(57) ABSTRACT

A hydraulic excavator includes: operation devices that output, based on operation by an operator, operation signals to operate a lower travel structure, an upper swing structure, and a front work implement; solenoid valves 23*a*, 23*b*, 24*a*, and 24*b* that limit the operation signals outputted from the operation devices; and a controller that controls the solenoid valves based on detection signals from sensors, and that detect objects in the surroundings of a machine body. The detection ranges of the sensors, and include a first detection range TR defined based on travel performance of the lower travel structure and a second detection range SW defined to be along a swing radius of a rear end of the upper swing structure. As a result, the influence of excessive alarm on the
(Continued)

working operator can be reduced while enhancing detection accuracy by setting the detection range according to action range of the work machine.

5 Claims, 11 Drawing Sheets

(51) Int. Cl.
*E02F 9/26* (2006.01)
*E02F 3/43* (2006.01)
*E02F 9/22* (2006.01)

(52) U.S. Cl.
CPC ..... *E02F 3/435* (2013.01); *E02F 9/2225* (2013.01); *E02F 9/2285* (2013.01); *E02F 9/2292* (2013.01); *E02F 9/2296* (2013.01)

(56) References Cited

U.S. PATENT DOCUMENTS

2018/0209122 A1* 7/2018 Kiyota ..... H04N 7/18
2018/0258616 A1* 9/2018 Kiyota ..... G06T 1/00
2019/0170879 A1 6/2019 Kinoshita et al.
2019/0284782 A1 9/2019 Izumikawa
2019/0360172 A1* 11/2019 Yamamoto ..... E02F 9/226
2020/0217049 A1 7/2020 Mizuochi et al.
2020/0291614 A1* 9/2020 Kiyota ..... G06V 40/20
2021/0010236 A1* 1/2021 Nishi ..... E02F 9/262
2021/0174660 A1 6/2021 Kamimura et al.
2021/0262203 A1 8/2021 Fujiwara
2022/0251803 A1* 8/2022 Ushijima ..... E02F 9/262

FOREIGN PATENT DOCUMENTS

JP 0528382 A 2/1993
JP 5-321304 A 12/1993
JP 2006-195877 A 7/2006
JP 2017206952 A 11/2017
JP 2019-105105 A 6/2019
JP 2020-007867 A 1/2020
WO 2018/105527 A1 6/2018
WO 2019/117268 A1 6/2019

OTHER PUBLICATIONS

Korean Office Action received in corresponding Korean Application No. 10-2022-7007964 dated Sep. 20, 2023.
International Search Report of PCT/JP2020/040512 dated Jan. 12, 2021.
International Preliminary Report on Patentability received in corresponding International Application No. PCT/JP2020/040512 dated May 12, 2022.
Chinese Office Action received in corresponding Chinese Application No. 202080063682.4 dated Dec. 28, 2022.

* cited by examiner

WORK MACHINE

TECHNICAL FIELD

The present invention relates a work machine.

BACKGROUND ART

In a work machine such as a hydraulic excavator, as a technology concerning operation support, there has been known a technology in which an image obtained by a camera provided on a machine body is displayed on a monitor in a cabin, thereby to assist the operator in monitoring the surroundings of the work machine.

For example, Patent Document 1 discloses an excavator that includes a travel structure, a swing structure mounted on the travel structure, imaging means for imaging a predetermined range in the surroundings of the swing structure, and object detecting means for detecting a predetermined object in a first range included in the predetermined range.

In addition, Patent Document 2 discloses an alarm system for a work machine that includes potential zone setting means for setting a plurality of imaginary risk potential zones becoming higher in risk in going toward the work machine in the surroundings of the work machine, position sensing means for sensing the position of a target object to be sensed relative to the work machine, determining means for determining whether or not the position sensed by the position sensing means is located in any one of the plurality of imaginary risk potential zones, and alarm means for generating an alarm, in which when it is sensed, based on the determination result of the determining means, that the target object to be sensed is moved from a lower risk zone to a higher risk zone of the plurality of imaginary risk potential zones, the alarm means is driven to generate an alarm.

PRIOR ART DOCUMENTS

Patent Documents

Patent Document 1: JP-2017-206952-A
Patent Document 2: JP-H5-028382-A

SUMMARY OF THE INVENTION

Problem to be Solved by the Invention

In a work machine such as a hydraulic excavator, a work is conducted by not only an action of a front work mechanism but also various actions such as swing action and travel action being performed. Therefore, it is necessary to set a detection range according to action range of each section of the hydraulic excavator, thereby to monitor the surroundings. However, in the aforementioned prior art, it is necessary to set a very wide detection range in consideration of the action range of the work machine, and therefore, an object in a range unnecessary for detection is detected, thus excessive alarm would hinder the working of the operator.

The present invention has been made in consideration of the aforementioned circumstances. It is an object of the present invention to provide a work machine capable of reducing the influence of excessive alarm on the working operator, while enhancing detection accuracy by setting a detection range according to the action range of the work machine.

Means for Solving the Problem

The present application includes a plurality of means for solving the above-mentioned problem, one example of which is a work machine provided with a machine body including a lower travel structure and an upper swing structure provided swingably relative to the lower travel structure, the work machine including: an operation device that outputs, based on operation by an operator, operation signals for operating the lower travel structure and the upper swing structure; a sensor that detects an object in surroundings of the machine body; a safety support device having at least one of a limiting device that limits action of the machine body and an alarm device that gives an alarm to the operator; and a controller that controls the safety support device based on a detection signal from the sensor, in which a detection range of the sensor includes a first detection range defined based on travel performance of the lower travel structure and a second detection range defined to be along a swing radius of a rear end of the upper swing structure.

Advantages of the Invention

According to the present invention, the influence of excessive alarm on the working operator can be reduced, while enhancing the detection accuracy by setting a detection range according to the action range of a work machine.

MODES FOR CARRYING OUT THE INVENTION

First Embodiment

An embodiment of the present invention will be described below while referring to FIGS. 1 to 11. Note that in the present embodiment, description will be made by indicating a hydraulic excavator as an example of a work machine, but the present invention is applicable also to other work machines such as a crane and road machines such as a wheel loader.

Figure 1:
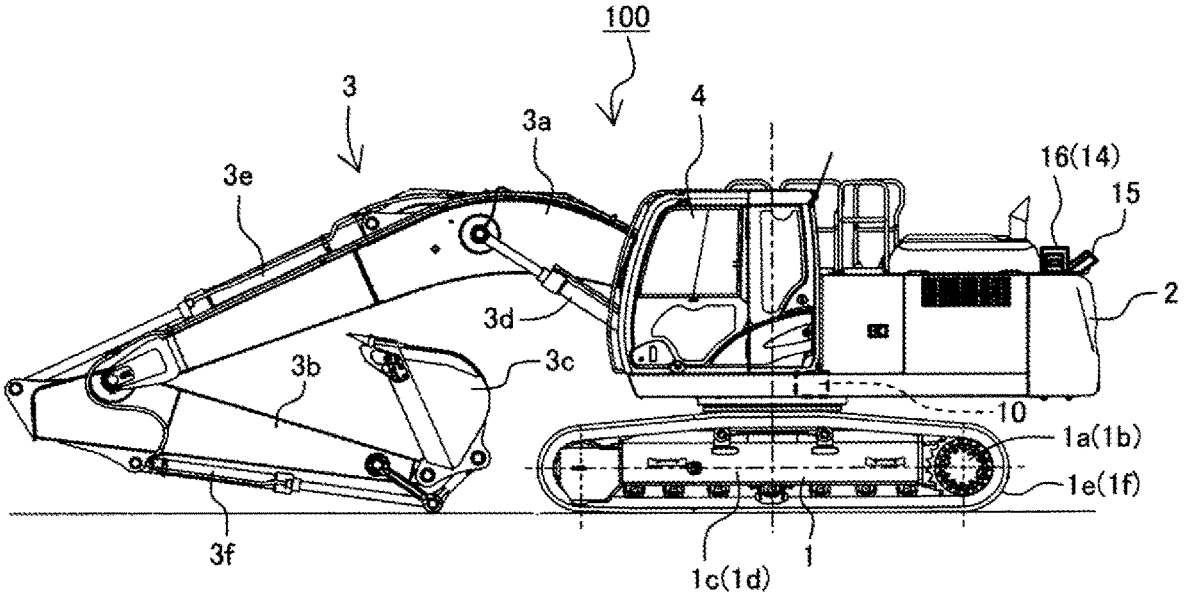
FIG. 1 is a side view schematically depicting the appearance of a hydraulic excavator which is an example of a work machine.
Figure 2:
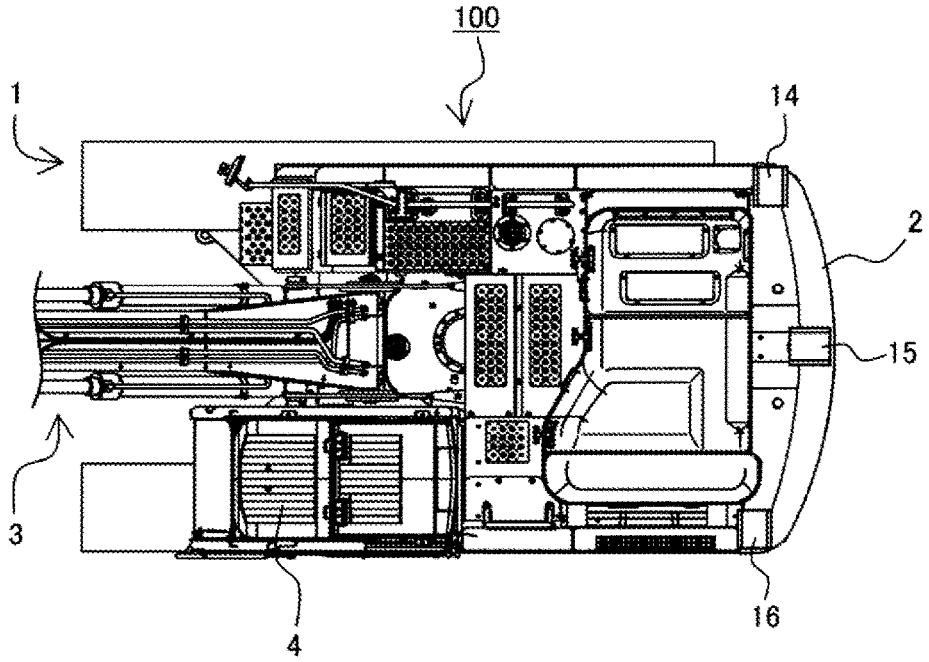
FIG. 2 is a top plan view schematically depicting the appearance of the hydraulic excavator which is an example of the work machine.
Figure 3:
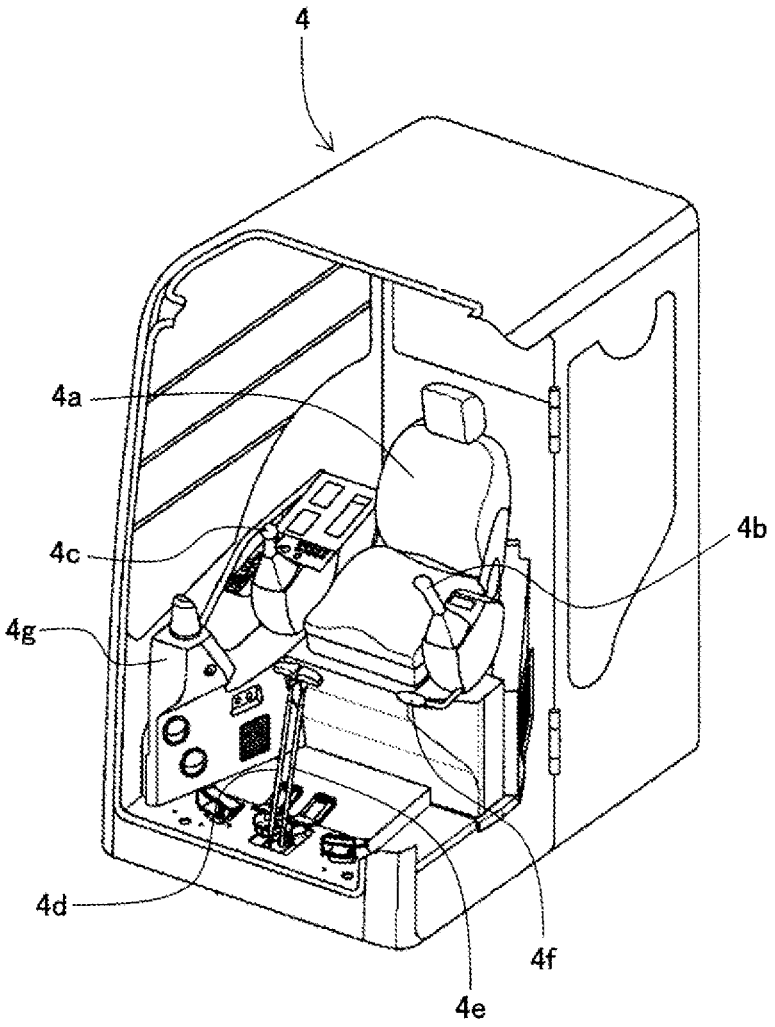
FIG. 3 is a partly sectional perspective view depicting a cabin on a drawing-out basis.

FIGS. 1 and 2 are diagrams schematically depicting the appearance of a hydraulic excavator as an example of the work machine according to the present embodiment, and FIG. 1 is a side view and FIG. 2 is a top plan view. In addition, FIG. 3 is a partly sectional perspective view depicting a cabin on a drawing-out basis.

In FIGS. 1 and 2, the hydraulic excavator 100 generally includes a machine body that includes a crawler type lower travel structure 1 and an upper swing structure 2 provided swingably relative to the lower travel structure 1, and a front work implement 3 provided on the front side of the upper swing structure 2 in an elevatable manner. Note that in FIG. 2, a part of the front work implement 3 is omitted for simplification of illustration.

The front work implement 3 is configured by coupling a plurality of driven members (a boom 3*a*, an arm 3*b*, and a bucket 3*c*) to each other that are each turned in the vertical direction. A base end of the boom 3*a* is rotatably supported on a front part of the upper swing structure 2. In addition, one end of the arm 3*b* is rotatably coupled to a tip end of the boom 3*a*, and the bucket 3*c* is rotatably coupled to the other end (tip end) of the arm 3*b*. The boom 3*a*, the arm 3*b*, and the bucket 3*c* are driven respectively by a boom cylinder 3*d*, an arm cylinder 3*e*, and a bucket cylinder 3*f* which are hydraulic actuators.

The lower travel structure 1 includes a pair of crawlers 1*e* and 1*f* arranged respectively around a pair of left and right crawler frames 1*c* and 1*d*, and travel hydraulic motors 1*a* and 1*b* as hydraulic actuators that respectively drive the crawlers 1*e* and 1*f* through a velocity reduction mechanism and the like which are not illustrated. Note that in FIG. 1, in regard of each configuration of the lower travel structure 1, only one of the pair of left and right configurations is illustrated and denoted by a symbol, whereas the other configuration is denoted by a parenthesized symbol in the figure and illustration thereof is omitted.

The upper swing structure 2 is configured by disposing members on a swing frame which becomes a base section, and the swing frame is driven to swing relative to the lower travel structure 1 by a swing hydraulic motor 10 which is a hydraulic actuator, whereby the upper swing structure 2 can swing relative to the lower travel structure 1. In addition, though not illustrated, a swing angle sensor that senses the relative angle of the upper swing structure 2 relative to the lower travel structure 1 is provided at a coupling section between the lower travel structure 1 and the upper swing structure 2.

Figure 4:
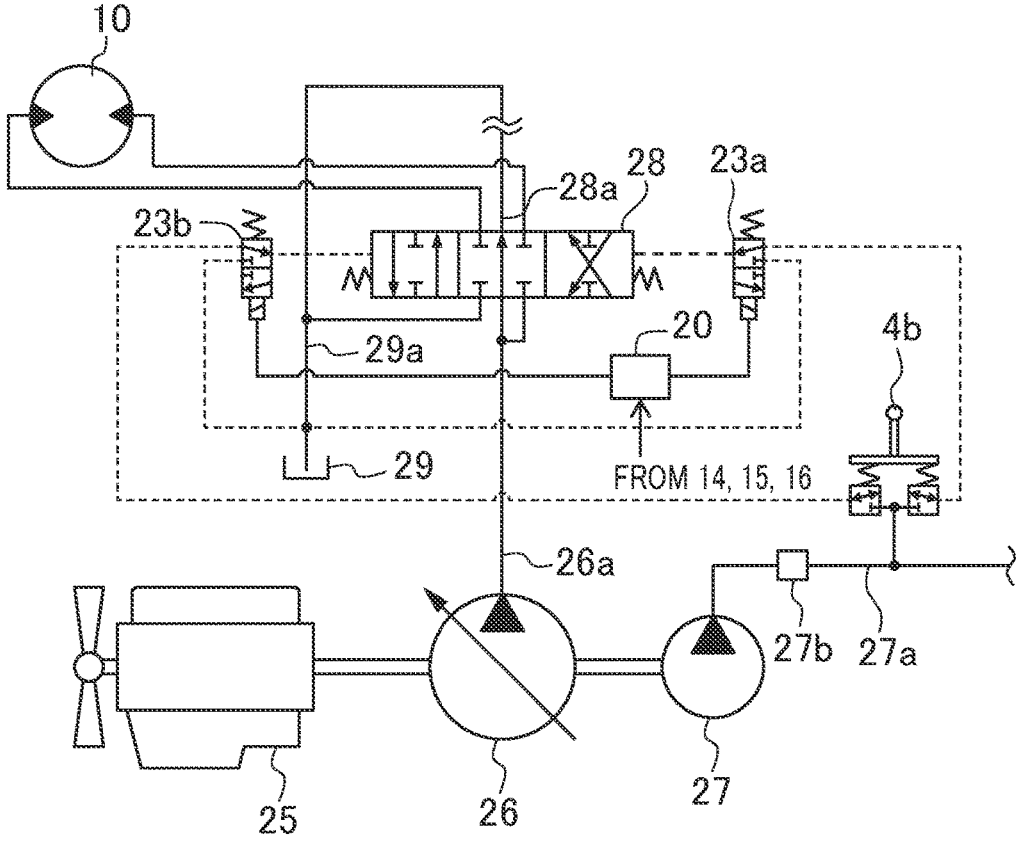
FIG. 4 is a diagram schematically depicting a part of a hydraulic circuit system applied to the hydraulic excavator together with a related configuration on a drawing-out basis.

On the front side of the swing frame of the upper swing structure 2, a cabin 4 in which the operator rides to perform operation of the hydraulic excavator 100 is disposed, and an engine 25 as a prime mover, a hydraulic pump 26 and a pilot pump 27 which are driven by the engine 25, and a hydraulic circuit system for driving each of the hydraulic actuators (the travel hydraulic motors 1*a* and 1*b*, the swing hydraulic motor 10, the boom cylinder 3*d*, the arm cylinder 3*e*, and the bucket cylinder 3*f*) are mounted (see FIG. 4 set forth later). In addition, a controller 20 that controls action of the hydraulic excavator 100 as a whole is disposed on the upper swing structure 2.

As depicted in FIG. 3, a seat 4*a* on which the operator is seated, operation devices 4*b*, 4*c*, 4*d*, and 4*e* for performing driving operation of the front work implement 3, swing operation of the upper swing structure 2, and travel operation of the lower travel structure 1, a gate lock lever 4*f*, and a monitor 4*g* disposed at a position easy for the operator seated on the seat 4*a* to look at and not becoming an obstacle to an external field of view, are provided in the cabin 4.

On the left and right sides and the rear side of an upper part of the upper swing structure 2, there are mounted a plurality of sensors 14, 15, and 16 for detecting objects in the surroundings of the upper swing structure 2. The sensors 14, 15, and 16 constitute a part of a surrounding monitoring system (described later) for monitoring the surroundings as an operation support for the operator in the hydraulic excavator 100. The plurality of sensors 14, 15, and 16 are respectively referred to as a right side sensor 14, a rear side sensor 15, and a left side sensor 16 according to the disposition thereof. In other words, the plurality of sensors 14, 15, and 16 are configured to have the left side sensor 16 that is provided on the rear side of the cabin 4 on the left side of the upper swing structure 2 and has the front side and the left side of the upper swing structure 2 as a detection range, the right side sensor 14 that is provided on the right side of the upper swing structure 2 and has the front side and the right side of the upper swing structure 2 as a detection range, and the rear side sensor 15 that is provided on the rear side of the upper swing structure 2 and has the left and right sides and the rear side of the upper swing structure 2 as a detection range.

FIG. 4 is a diagram depicting a part of the hydraulic circuit system applied to the hydraulic excavator together with a related configuration in a drawing-out manner. Note that in FIG. 4, a configuration concerning the swing hydraulic motor 10 is depicted as a representative one of the plurality of hydraulic actuators of the hydraulic excavator 100, the travel hydraulic motors 1*a* and 1*b*, the boom cylinder 3*d*, the arm cylinder 3*e*, and the bucket cylinder 3*f* are also configured similarly.

In FIG. 4, the hydraulic circuit system includes the engine 25 which is a prime mover, the hydraulic pump 26 and the pilot pump 27 which are driven by the engine 25, a plurality of hydraulic actuators driven by a hydraulic oil delivered from the hydraulic pump 26 (here, only the swing hydraulic motor 10 is illustrated), a plurality of directional control valves that control the flow of the hydraulic oil supplied from the hydraulic pump 26 to the plurality of hydraulic actuators (here, only the directional control valve 28 concerning the swing hydraulic motor 10 is illustrated), and a plurality of hydraulic pilot type operation devices that give instructions about operation of the plurality of hydraulic actuators and generate a pilot pressure (operation signal) for changing over the plurality of directional control valves (here, only the operation device 4*b* concerning swing operation is illustrated).

The directional control valve 28 is of a center bypass type, and has a center bypass passage located on a center bypass line 28*a*. The center bypass passage is connected in series with the center bypass line 28*a*, and the center bypass passage communicates with the center bypass line 28*a* when a spool of the directional control valve 28 is in a neutral position, whereas the communication of the center bypass passage with the center bypass lie 28*a* is interrupted when the spool of the directional control valve 28 is changed over to a change-over position on the left side or the right side in FIG. 4. An upstream side of the center bypass line 28*a* is connected to a delivery line 26*a* of the hydraulic pump 26, while a downstream side of the center bypass line 28*a* is connected to a hydraulic tank 29 through a tank line 29*a*.

The directional control valve 28 is changed over by a pilot pressure (operation signal) from the operation device 4*b*. The operation device 4*b* has a pair of pilot valves that generate the pilot pressure with the delivery pressure of the pilot pump 27 as an original pressure according to an operation amount. Therefore, for example, when the operation device 4*b* is operated in a direction (for example, left side) corresponding to left swing from the neutral position, a pilot pressure generated by the pilot valve on one side according to the operation amount is outputted as an operation signal to a pressure receiving section on the right side in FIG. 4 of the directional control valve 28, whereby the directional control valve 28 is changed over to a change-over position on the right side in FIG. 4, the swing hydraulic motor 10 is rotated, and the upper swing structure 2 swings leftward relative to the lower travel structure 1. On the other hand, for example, when the operation device 4*b* is operated in a direction (for example, right side) corresponding to right swing from the neutral position, a pilot pressure generated by the pilot valve on the other side according to the operation amount is outputted as an operation signal to a pressure receiving section on the left side in FIG. 4 of the directional control valve 28, whereby the directional control valve 28 is changed over to a change-over position on the left side in FIG. 4, the swing hydraulic motor 10 is rotated, and the upper swing structure 2 swing rightward relative to the lower travel structure 1.

Solenoid valves 23*a* and 23*b* are provided respectively in lines from the operation device 4*b* to the two pressure receiving sections of the directional control valve 28. The solenoid valves 23*a* and 23*b* constitute a limiting device that limits the pilot pressure (operation signal) outputted from the operation device 4*b* to the directional control valve 28, and limits the pilot pressure (operation signal) based on a solenoid valve current (command signal) from the controller 20 described later, thereby to limit the operation velocity of the swing hydraulic motor 10 which is a hydraulic actuator.

Figure 6:
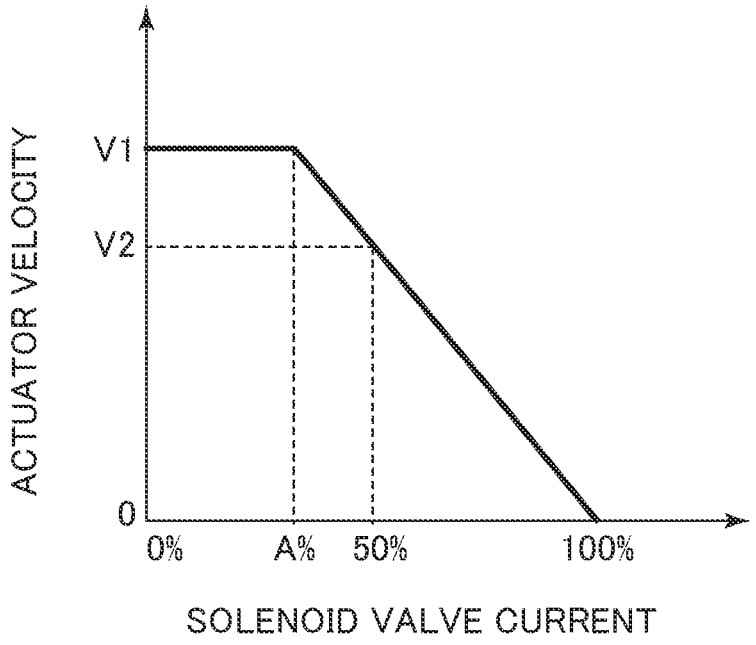
FIG. 6 is a diagram depicting an example of the relation between a solenoid valve current outputted from a controller to a solenoid valve and actuator velocity.

FIG. 6 is a diagram depicting an example of the relation between the solenoid valve current outputted from the controller to the solenoid valve and actuator velocity. In FIG. 6, the axis of abscissas represents the proportion of the solenoid valve current outputted from the controller 20 to the solenoid valves 23*a* and 23*b* relative to a predetermined value. Here, an example where the value of the solenoid valve current at which the solenoid valves 23*a* and 23*b* are fully closed is 100% is depicted. In addition, in FIG. 6, the axis of ordinates represents a case where the velocity of the hydraulic actuator in the case where the pilot pressure outputted from the operation device 4*b* to the directional control valve 28 is not limited is V1. In other words, in FIG. 6, when the solenoid valve current is 0 (zero) %, the hydraulic actuator operates at the velocity V1 according to the pilot pressure outputted from the operation device 4*b*, the velocity of the hydraulic actuator is reduced as an increase in the solenoid valve current when the solenoid valve current increases to exceed a predetermined proportion (for example, A %), the velocity of the hydraulic actuator is limited to V2 (<V1) when the solenoid valve current becomes 50%, and the velocity of the hydraulic actuator is limited to 0 (zero) when the solenoid valve current becomes 100%.

A pilot relief valve (not illustrated) that keeps constant the delivery pressure of the pilot pump 27 is provided in the delivery line 27*a* of the pilot pump 27. In addition, a lock valve 27*b* is provided in the delivery line 27*a* of the pilot pump 27, and the lock valve 27*b* is changed over according to an operation of a gate lock lever 4*f*. The gate lock lever 4*f* has a position switch (not illustrated) that is put into a closed state when the gate lock lever 4*f* is in an unlock position (lowered position), and that is put into an open state when the gate lock lever 4*f* is in a lock position (raised position). For example, when the gate lock lever 4*f* is operated to a processing position and the position switch is put into the closed position, a solenoid section of the lock valve 27*b* is energized through the position switch, and the lock valve 27*b* is changed over to a communicating position. As a result, the delivery line 27*a* of the pilot pump 27 is made to communicate, and the delivery pressure of the pilot pump 27 is introduced into the operation device 4*b* and the like. In other words, generation of the pilot pressure by operation of the operation device 4*b* or the like becomes possible, and the hydraulic actuator can be operated (workable state). On the other hand, when the gate lock lever 4*f* is operated to the raised position and the position switch is put into the open state, the lock valve 27*b* is changed over to the interrupting position. As a result, the communication of the delivery line 27*a* of the pilot pump 27 is interrupted. In other words, a state in which the pilot pressure is not generated even if the operation device 4*b* or the like is operated is established, and the hydraulic actuator is not operated (unworkable state).

Note that a hydraulic circuit system concerning the left and right hydraulic motors 1*a* and 1*b*, the boom cylinder 3*d*, the arm cylinder 3*e*, and the bucket cylinder 3*f* not illustrated in FIG. 4 also has a similar configuration.

In addition, the solenoid valves 24*a* and 24*b* are provided respectively in the lines from the operation devices 4*d* and 4*e* concerning to at least travel operation to the two pressure receiving sections of the respective directional control valves (not illustrated) of the travel hydraulic motors 1*a* and 1*b*, and, by limiting the pilot pressure (operation signal) based on the solenoid valve current (command signal) from the controller 20, operation velocities of the travel hydraulic motors 1*a* and 1*b* which are hydraulic actuators are limited.

The hydraulic excavator 100 of the present embodiment configured as aforementioned has a surrounding monitoring system that performs operation support for the operation by monitoring the surroundings of the hydraulic excavator 100 based on the detection results of the sensors 14, 15, and 16.

Figure 5:
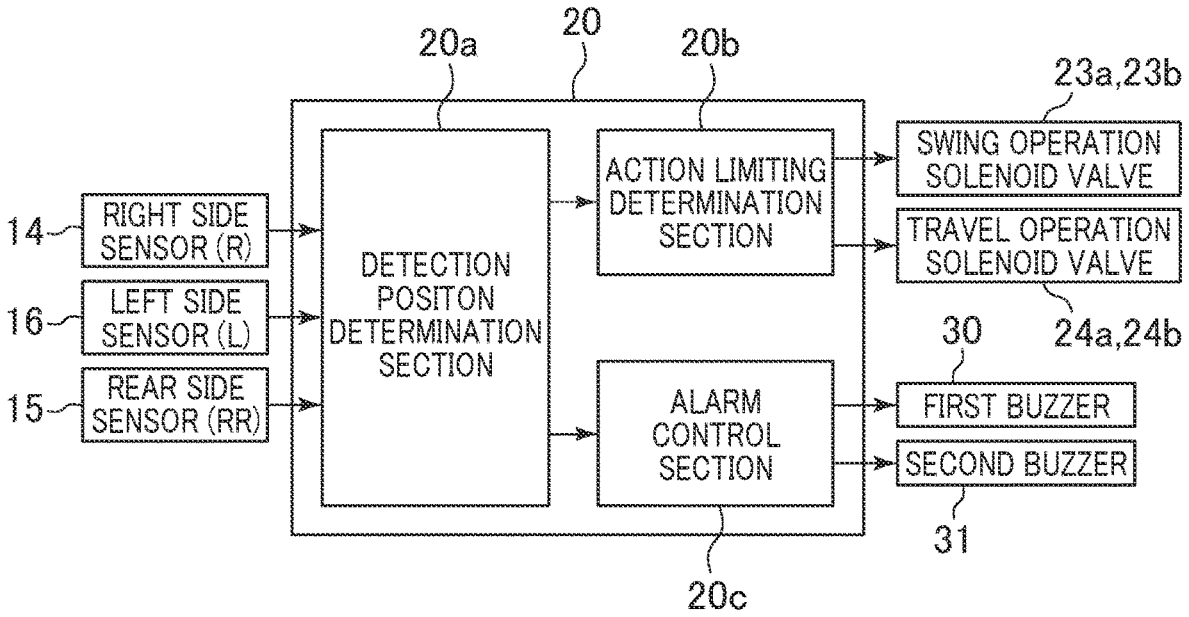
FIG. 5 is a functional block diagram schematically depicting a configuration concerning a surrounding monitoring system of the hydraulic excavator on a drawing-out basis.

FIG. 5 is a functional block diagram schematically depicting the configuration concerning the surrounding monitoring system of the hydraulic excavator according to the present embodiment.

In FIG. 5, the surrounding monitoring system includes the plurality of sensors 14, 15, and 16, the solenoid valves 23*a*, 23*b*, 24*a*, and 24*b* as limiting devices, the first buzzer 30 and the second buzzer 31 as alarm devices, and the controller 20 that generates and outputs command signals to the solenoid valves 23*a*, 23*b*, 24*a*, and 24*b* and command signals to the first buzzer 30 and the second buzzer 31, based on the detection results (detection signals) of the plurality of sensors 14, 15, and 16.

Here, the limiting devices (the solenoid valves 23*a*, 23*b*, 24*a*, and 24*b*) and the alarm devices (the first buzzer 30 and the second buzzer 31) constitute a part of a safety support device that performs operation support for the operator in the surrounding monitoring system. The limiting devices limit travel operation and swing operation of the hydraulic excavator 100 according to the detection results of the sensors 14, 15, and 16, thereby to perform operation support for the operator. In addition, the alarm devices issue an alarm to the operator according to the detection results of the sensors 14, 15, and 16, thereby to perform operation support for the operator. Note that In the present embodiment, a case where operation support is performed by limiting the operation of the work machine or issuing an alarm or the like to the operator in the safety support device of the surrounding monitoring system has been exemplified, but other functions for operation support for the operator may be added to the surrounding monitoring system.

The sensors 14, 15, and 16 are sensors for detecting the distance and direction from the sensors 14, 15, and 16 to an object and for outputting the position of the detected object in a three-dimensional coordinate system as a detection result, and are, for example, infrared depth sensors. Since the relative mounting positions of the sensors 14, 15, and 16 relative to the upper swing structure 2 are predetermined by design information or the like, the relative position (relative position in the three-dimensional coordinate system) of the detected object relative to the upper swing structure 2 can be specified from the design information and the detection results of the sensors 14, 15, and 16.

Figure 7:
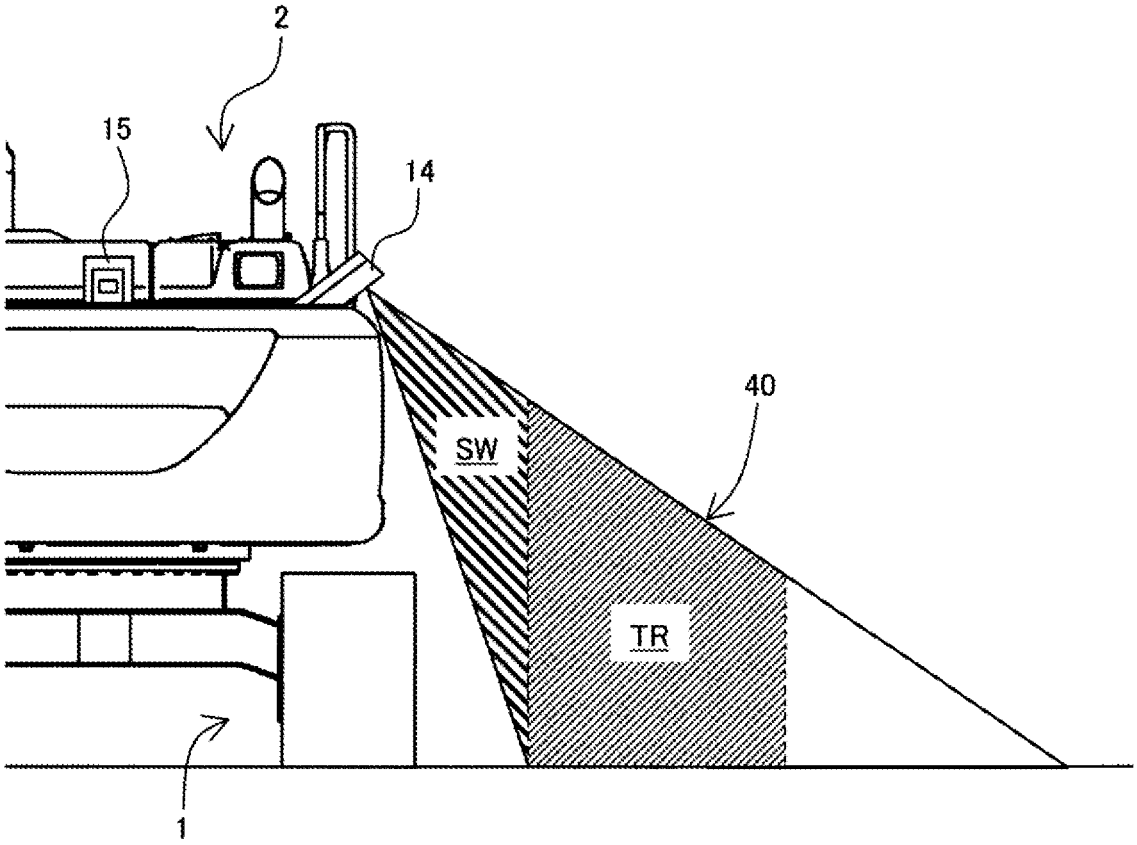
FIG. 7 is a diagram depicting a detectable range of a sensor.

FIG. 7 is a diagram depicting the detectable ranges of the sensors, and depicts the sections of the detectable ranges in a perpendicular plane including the sensors. In FIG. 7, the detectable range of the right side sensor 14 among the sensors 14, 15, and 16 is depicted on a representative basis. In addition, FIG. 8 is a top plan view depicting the detectable ranges of the sensors and the detection ranges set in the surroundings of the machine body.

Figure 8:
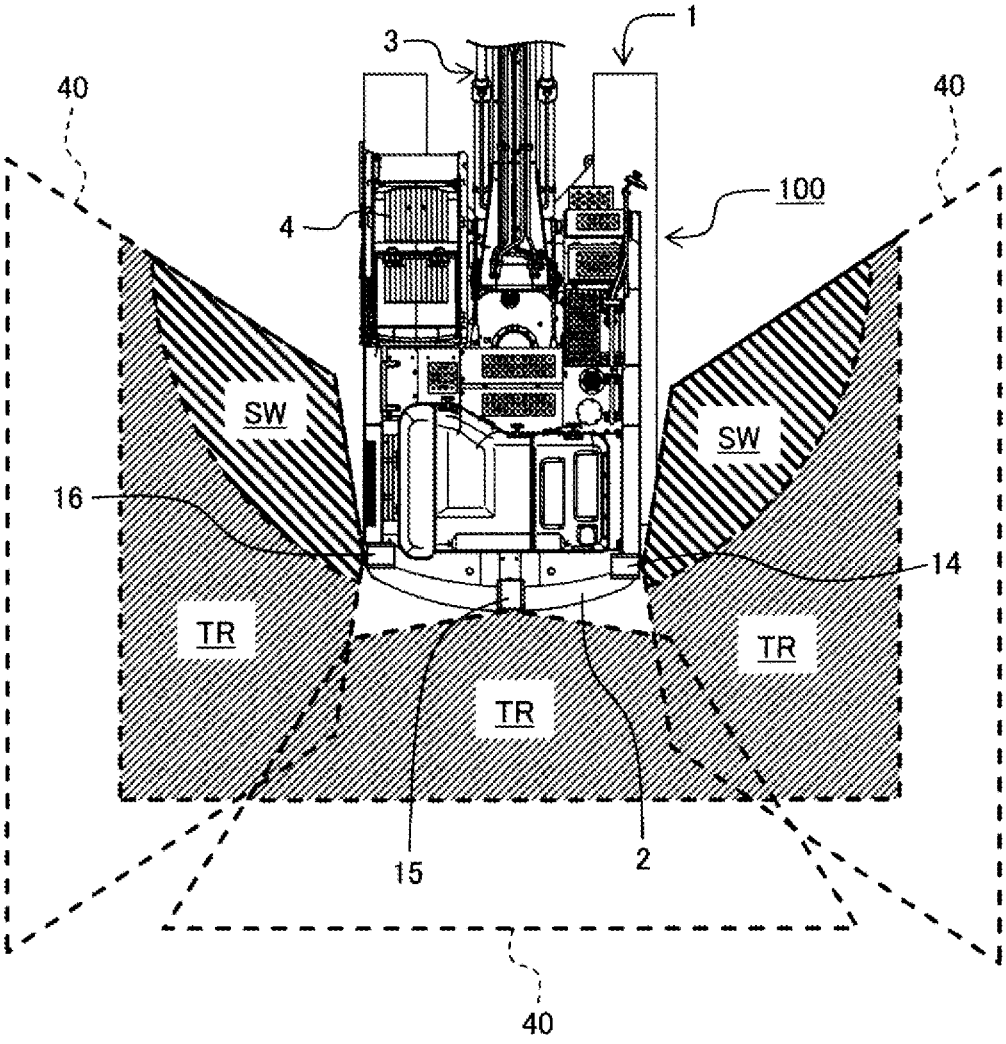
FIG. 8 is a top plan view depicting the detectable range of the sensor and a detection range set in the surroundings of a machine body.

As depicted in FIGS. 7 and 8, a detectable range 40 of the sensor 14 is a pyramid-shaped space with the sensor 14 as the apex, which includes a space from a position along the vertical direction and the front-rear direction of the machine body (the lower travel structure 1 and the upper swing structure 2) to a predetermined distance. The sensors 15 and 16 are also similar.

As depicted in FIG. 8, in the surroundings of the machine body of the hydraulic excavator 100, a first detection range TR and a second detection range SW are set so as to be included in the detectable ranges 40 of the sensors 14, 15, and 16.

The first detection range TR is set based on travel performance of the lower travel structure 1 of the hydraulic excavator 100. Specifically, first, a distance (reachable distance) which the machine body can reach from an initial position in the case of supposing that the lower travel structure 1 travels at a maximum traveling velocity is calculated. Subsequently, as a boundary for defining the periphery of the first detection range TR, boundaries extending in the front-rear direction so as to be along the left and right side surfaces of the upper swing structure 2 and a boundary extending in the left-right direction so as to be along a rear end surface are determined. In this instance, each of the boundaries of the first detection range TR is set so as to have the reachable distance from the upper swing structure 2. The inside (machine body side) of the boundaries thus set is made to be the first detection range TR.

Note that a case where the shape of the first detection range TR is a polygon constituted of straight lines along the side surfaces and the rear end of the upper swing structure 2 has been exemplified in the present embodiment, but this is not limitative; for example, the shape of the first detection range TR may be modified based on the sensing result of the swing angle sensor.

In addition, the second detection range SW is set based on swing range of the upper swing structure 2. Specifically, a boundary of the second detection range SW is defined along the locus (swing radius) at the time of swing action of the rear end of the upper swing structure 2, and the inside (machine body side) of the boundary is made to be the second detection range SW. In this instance, the boundary of the second detection range SW may be set so as to be a position having a predetermined distance outward from the rear end of the upper swing structure 2.

The controller 20 has a detection position determination section 20*a*, an action limiting determination section 20*b*, and an alarm control section 20*c* as functional sections concerning the surrounding monitoring system.

The detection position determination section 20*a* determines whether the detection position of an object detected based on the detection results of the sensors 14, 15, and 16 is in either the first detection range TR or the second detection range SW, and outputs the determination result to the action limiting determination section 20*b* and the alarm control section 20*c*. The detection position determination section 20*a* has information concerning the first detection range TR and the second detection range SW, and, by comparing the detection results (position information) of the sensors 14, 15, and 16 with the first detection range TR and the second detection range SW, it can determine whether the detected object is at a position in either the first detection range TR or the second detection range SW.

The action limiting determination section 20*b* controls the solenoid valves 23*a*, 23*b*, 24*a*, and 24*b* as limiting devices that limit the operation signals outputted from the operation devices 4*b*, 4*c*, 4*d*, and 4*e*, based on the detection result of the detection position determination section 20*a*, that is, based on whether the position of the object detected is in either the first detection range TR or the second detection range SW, thereby to limit at least one of the travel action of the lower travel structure 1 and the swing action of the upper swing structure 2 relative to the lower travel structure 1.

The alarm control section 20*c* controls the first buzzer 30 and the second buzzer 31, according to the detection result of the detection position determination section 20*a*, that is, according to whether the position of the object detected is in either the first detection range TR or the second detection range SW, thereby to issue different kinds of alarm to the operator.

Figure 9:
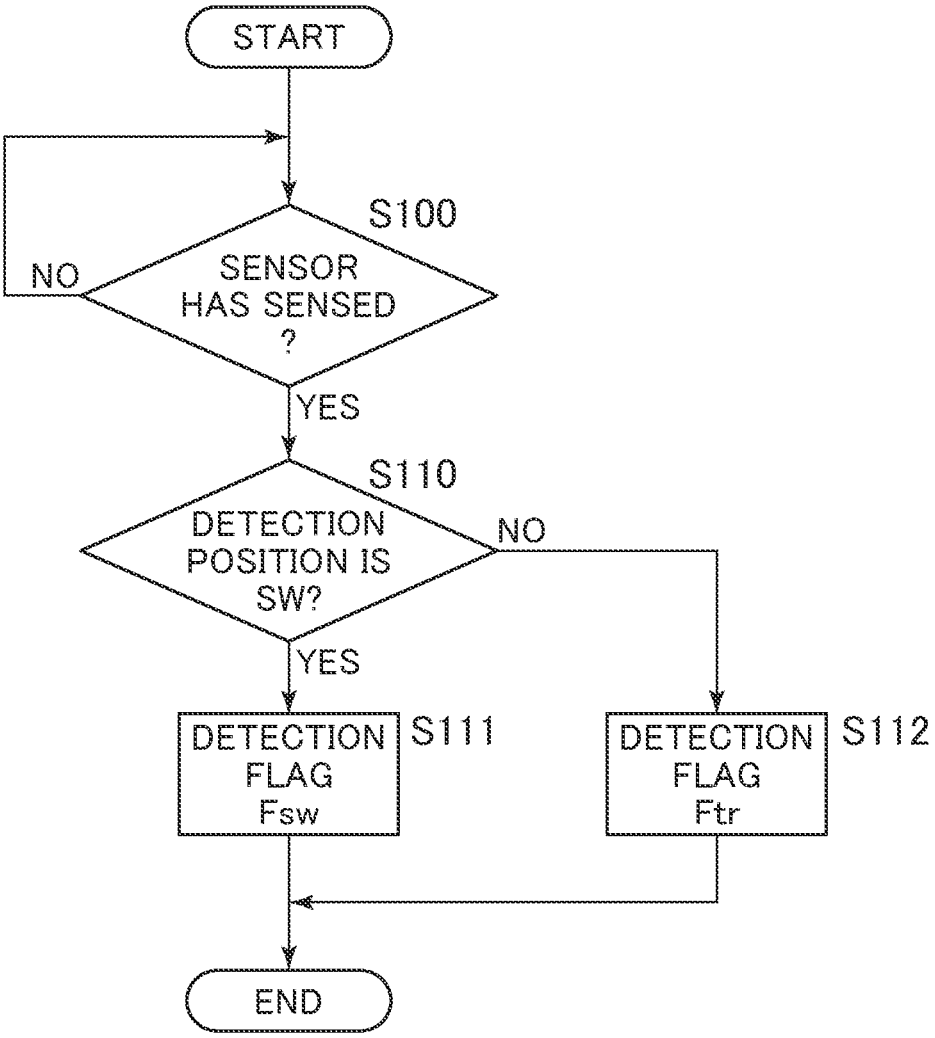
FIG. 9 is a flow chart depicting the processing contents of a detection position determination section.

FIG. 9 is a flow chart depicting the processing contents of the detection position determination section. FIG. 10 is a flow chart depicting the processing contents of the action limiting determination section, and FIG. 11 is a flow chart depicting the processing contents of the alarm control section.

As depicted in FIG. 9, the detection position determination section 20*a* first determined whether or not an object has been detected in the first detection range TR or the second detection range SW, based on the detection results of the sensors 14, 15, and 16 (step S100). When the determination result in step S100 is NO, the processing of step S100 is repeated until an object is detected.

In addition, when the determination result in step S100 is YES, it is determined whether or not the position at which the object has been detected is in the second detection range SW (step S110), and, if the determination result is YES, Fsw is outputted as a detection flag to the action limiting determination section 20*b* and the alarm control section 20*c* (step S111), and the process is finished. In addition, when the determination result in step S110 is NO, that is, when the detection position of the object is in the first detection range TR, Ftr is outputted as a detection flag to the action limiting determination section 20*b* and the alarm control section 20*c* (step S112), and the process is finished.

Figure 10A:
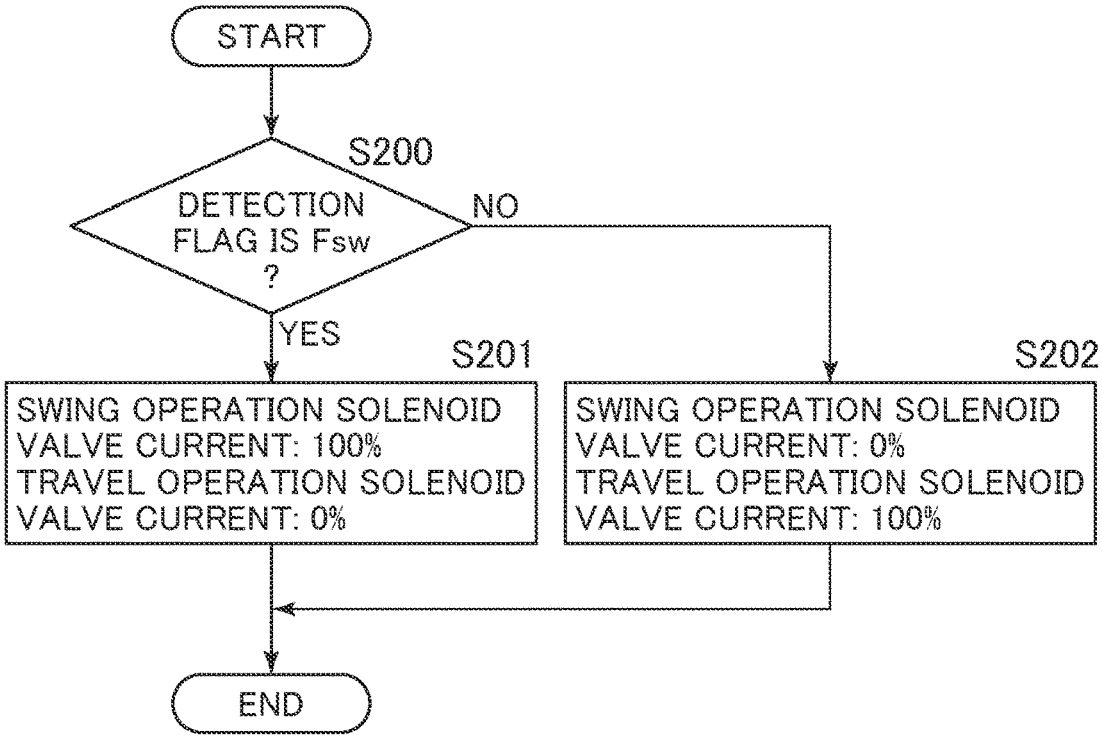
FIG. 10A is a flow chart depicting the processing contents of an action limiting determination section according to a first embodiment.
Figure 11:
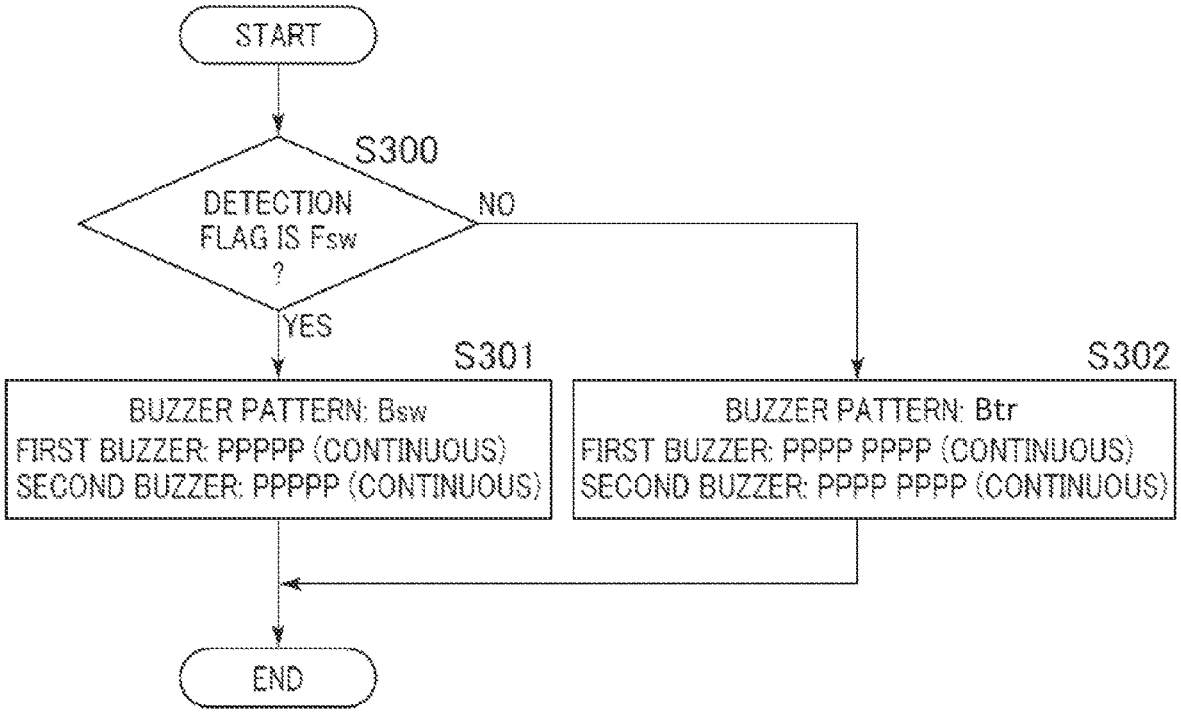
FIG. 11 is a flow chart depicting the processing contents of an alarm control section.

As depicted in FIG. 10A, the action limiting determination section 20*b* determines whether or not the detection flag outputted from the detection position determination section 20*a* is Fsw (step S200), and, when the determination result is YES, the solenoid valve currents outputted to the swing solenoid valves 23*a* and 23*b* are set to 100%, while the solenoid valve currents outputted to the travel solenoid valves 24*a* and 24*b* are set to 0 (zero) %, thereby to limit (stop) the velocity of swing action without limiting travel action (step S201), and the process is finished. In other words, when an object (for example, a worker) is detected in the second detection range SW defined based on the swing range of the upper swing structure 2, the swing action is stopped while maintaining the travel action, whereby the contact of the hydraulic excavator 100 with the object (worker) can be suitably prevented while restraining a lowering in working efficiency.

In addition, when the determination result in step S200 is NO, that is, when the detection flag outputted from the detection position determination section 20*a* is Ftr, the solenoid valve currents outputted to the swing solenoid valves 23*a* and 23*b* are set to 0 (zero) %, while the solenoid valve currents outputted to the travel solenoid valves 24*a* and 24*b* are set to 100%, thereby to maintain the action velocity of swing action and to limit (stop) the travel action (step S202), and the process is finished. In other words, when an object (for example, a worker) is detected in the first detection range TR defined based on the travel performance of the lower travel structure 1, the swing velocity is maintained and the travel action is limited (stopped), whereby the contact of the hydraulic excavator 100 with the object (worker) can be suitably prevented while restraining a lowering in working efficiency.

As depicted in FIG. 11, the alarm control section 20*c* determines whether or not the detection flag outputted from the detection position determination section 20*a* is Fsw (step S300), and, when the determination result is YES, an instruction signal is outputted to the first buzzer 30 and the second buzzer 31 to sound in a buzzer pattern (Bsw) (step S301), and the process is finished. In addition, when the determination result in step S300 is NO, that is, when the detection position of the object is in the first detection range TR, an instruction signal is outputted to the first buzzer 30 and the second buzzer 31 to sound in a buzzer pattern (Btr) (step S302), and the process is finished. Note that the sounding method of the first buzzer 30 and the second buzzer 31 in each of the buzzer patterns (buzzer patterns (Btr) and (Bsw)) can be set optionally; for example, in the buzzer pattern (Bsw), the first buzzer 30 and the second buzzer 31 may be set to intermittently sound without any breaks, and, in the buzzer pattern (Btr), the first buzzer 30 and the second buzzer 31 may be set to repeat sounding and stopping at predetermined intervals.

Note that the buzzers (the first buzzer 30 and the second buzzer 31) that issue alarm sound have been exemplified as an alarm device in the description of the present embodiment, it is sufficient for the alarm device to be able to issue an alarm to the operator, and, for example, a device that issues an alarm to the operator by a sound different from the buzzer sound, or melody, light, vibration, image display, or a combination of these, may be used.

Advantageous effects of the present embodiment configured as above will be described.

In a work machine such as a hydraulic excavator, a work is conducted by not only an action of the front work implement but also various actions such as swing action and travel action being performed. Therefore, it is necessary to monitor the surroundings by setting detection ranges according to the action range of each section of the hydraulic excavator. However, in the prior art, since the detection distance from the sensor is set based on the action range of the front work implement of the work machine, the detection ranges become a wide range, and an object in a range where the operator's attention reaches is detected, thus an excessive alarm would hinder the work of the operator.

On the other hand, in the present embodiment, the hydraulic excavator 100 provided with a machine body including the lower travel structure 1 and the upper swing structure 2 provided swingably relative to the lower travel structure 1, and the front work implement 3 provided on the front side of the upper swing structure 2 in an elevatable manner, includes: the operation devices 4*b*, 4*c*, 4*d*, and 4*e* that output operation signals for operating the lower travel structure 1, the upper swing structure 2, and the front work implement 3 based on operation by an operator; the sensors 14, 15, and 16 that detect objects in the surroundings of the machine body; the safety support device that performs operation support for the operator; and the controller 20 that controls the safety support device based on the detection results of the sensors 14, 15, and 16, in which the controller 20 is configured to control the safety support device, when an object is detected by the sensors 14, 15, and 16, based on whether the detection position of an object is in either the first detection range TR predetermined based on travel performance of the lower travel structure 1 or the second detection range SW predetermined inside the first detection range TR based on swing range of the upper swing structure 2, and therefore, the influence of excessive alarm on the working operator can be reduced, while enhancing detection accuracy, by setting the detection range according to the action range of the work implement.

Second Embodiment

A second embodiment of the present invention will be described referring to FIG. 10B.

In the first embodiment, swing velocity is maintained and travel action is limited (stopped) when an object (for example, a worker) is detected in the first detection range TR, but in the present embodiment, both the swing action and the travel action are limited (stopped) in the same case.

Figure 10B:
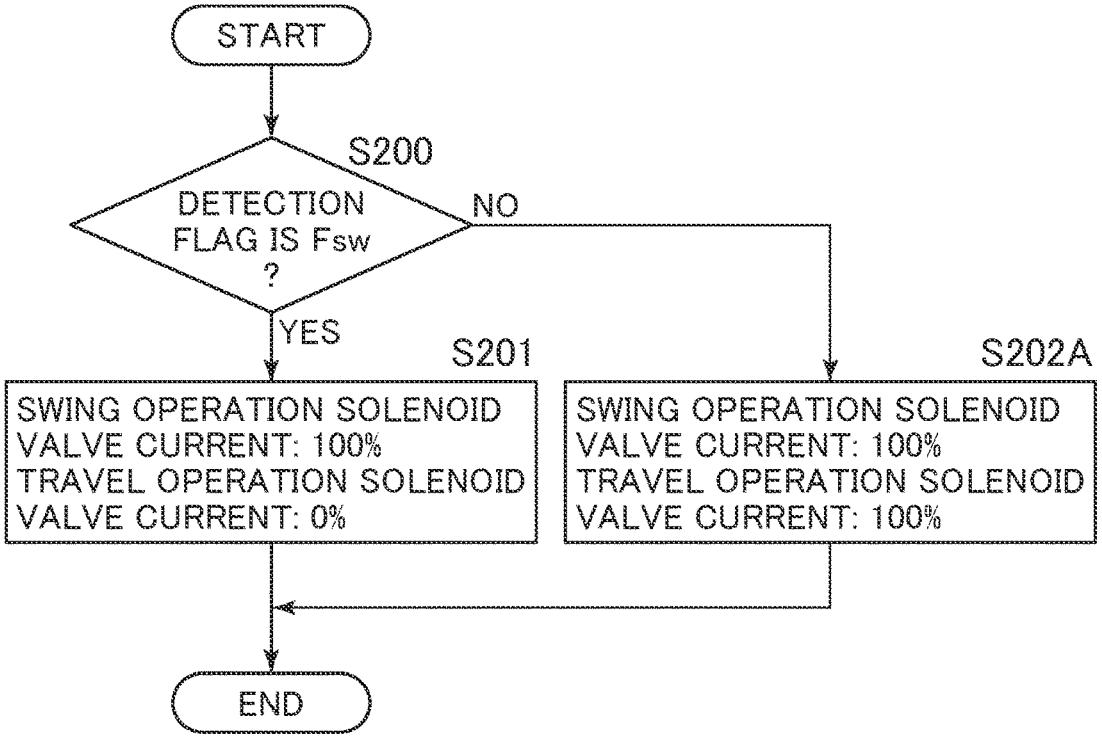
FIG. 10B is a flow chart depicting the processing contents of an action limiting determination section according to a second embodiment.

As depicted in FIG. 10B, the action limiting determination section 20*b* determines whether or not the detection flag outputted from the detection position determination section 20*a* is Fsw (step S200), and, when the determination result is YES, the solenoid valve currents outputted to the swing solenoid valves 23*a* and 23*b* are set to 100%, while the solenoid valve currents outputted to the travel solenoid valves 24*a* and 24*b* are set to 0 (zero) %, thereby to limit (stop) the velocity of swing action without limiting travel action (step S201), and the process is finished. In other words, when an object (for example, a worker) is detected in the second detection range SW defined based on the swing range of the upper swing structure 2, the swing action is stopped while maintaining the travel action, whereby the contact of the hydraulic excavator 100 with the object (worker) can be suitably prevented while restraining a lowering in working efficiency.

In addition, when the determination result in step S200 is NO, that is, when the detection flag outputted from the detection position determination section 20*a* is Ftr, the solenoid valve currents outputted to the swing solenoid valves 23*a* and 23*b* are set to 100%, and the solenoid valve currents outputted to the travel solenoid valves 24*a* and 24*b* are set to 100%, thereby to limit (stop) the swing action and the travel action (step S202A), and the process is finished. In other words, when an object (for example, a worker) is detected in the first detection range TR defined based on the travel performance of the lower travel structure 1, the swing action and the travel action are limited (stopped), whereby the contact of the hydraulic excavator 100 with the object (worker) can be suitably prevented.

Other points of configuration are similar to those of the first embodiment.

In the present embodiment configured as above, also, advantageous effects similar to those in the first embodiment can be obtained.

Third Embodiment

A third embodiment of the present invention will be described referring to FIG. 12.

In the first embodiment, a case where only the first detection range TR and the second detection range SW have been the target range for performing detection of an object, but, in the present embodiment, a case where the whole of the detectable range 40 is the target range for performing detection of an object is described.

Figure 12:
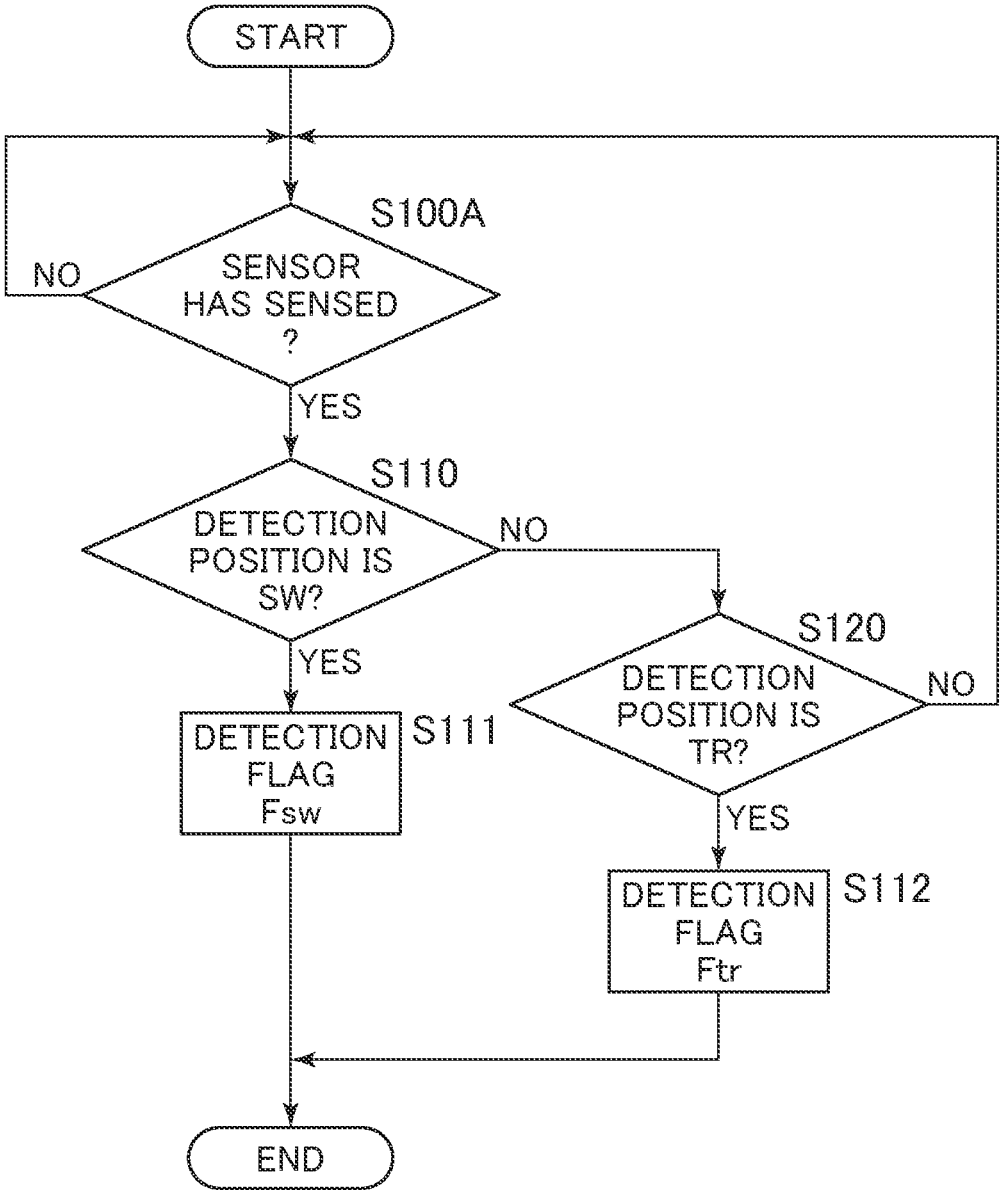
FIG. 12 is a flow chart depicting the processing contents of a detection position determination section according to a third embodiment.

FIG. 12 is a flow chart depicting the processing contents of the detection position determination section according to the present embodiment. In the figure, members similar to those in the first embodiment are denoted by the same reference symbols as used above, and descriptions thereof are omitted.

As depicted in FIG. 12, the detection position determination section 20*a* first determines whether or not an object has been detected in the detectable range 40 based on the detection results from the sensors 14, 15, and 16 (step S100A). When the determination result in step S100 is NO, the process of step S100A is repeated until an object is detected in the detectable range 40.

In addition, when the determination result in step S100A is YES, it is determined whether or not the position where the object has been detected is in the second detection range SW (step S110), and, when the determination result is YES, Fsw is outputted as a detection flag to the action limiting determination section 20*b* and the alarm control section 20*c* (step S111), and the process is finished.

Besides, when the determination result of step S110 is NO, it is determined whether or not the detection position is in the first detection range TR (step S120), and, when the determination result is YES, Ftr is outputted as a detection flag to the action limiting determination section 20*b* and the alarm control section 20*c* (step S112), and the process is finished.

In addition, when the determination result in step S120 is NO, that is, when the detection position of the object is neither in the first detection range TR nor in the second detection range SW, the process is finished.

Other points of configuration are similar to those of the first embodiment.

In the present embodiment configured as above, also, advantageous effects similar to those in the first embodiment can be obtained.

Fourth Embodiment

A fourth embodiment of the present invention will be described referring to FIG. 13.

In the first to third embodiments, a case where determination of the detection position is conducted by the controller 20 based on the detection results of the sensors 14, 15, and 16 has been exemplified, but, in the present embodiment, a case where determination of the detection position is conducted in respective ones of the sensors 14, 15, and 16 is described.

Figure 13:
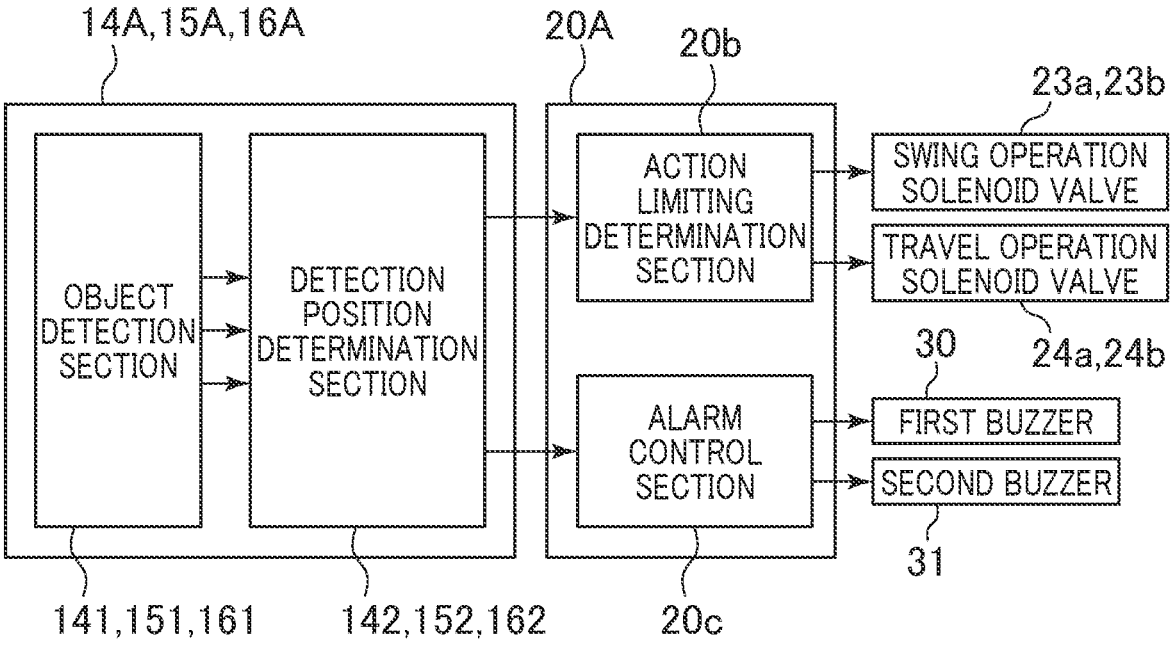
FIG. 13 is a functional block diagram schematically depicting a configuration concerning the surrounding monitoring system of the hydraulic excavator on a drawing-out basis.

FIG. 13 is a functional block diagram schematically depicting a configuration concerning the surrounding monitoring system of the hydraulic excavator according to the present embodiment. In the figure, members similar to those in the first embodiment are denoted by the same reference symbols as used above, and descriptions thereof are omitted.

In FIG. 13, the surrounding monitoring system includes: a plurality of sensors 14A, 15A, and 16A; the solenoid valves 23*a*, 23*b*, 24*a*, and 24*b* as limiting devices; the first buzzer 30 and the second buzzer 31 as alarm devices; and a controller 20A that generates and outputs command signals to the solenoid valves 23*a*, 23*b*, 24*a*, and 24*b* and command signals to the first buzzer 30 and the second buzzer 31 based on the detection flags from the plurality of sensors 14A, 15A and 16A.

Here, the limiting devices (the solenoid valves 23*a*, 23*b*, 24*a*, and 24*b*) and the alarm devices (the first buzzer 30 and second buzzer 31) constitute a part of a safety support device that performs operation support for the operator in the surrounding monitoring system. The controller performs operation support for the operator by limiting travel action and swing action of the hydraulic excavator 100 according to the detection results of the sensors 14A, 15A and 16A. In addition, the alarm devices performs operation support for the operator by issuing an alarm to the operator according to the detection results of the sensors 14A, 15A and 16A.

The sensors 14A, 15A, and 16A respectively have object detection sections 141, 151, and 161 that detect the distances and directions from the sensors 14A, 15A, and 16A to an object, and detection position determination sections 142, 152, and 162 that determine whether the position of the object detected by the detection sections 141, 151, and 161 is in either the first detection range TR or the second detection range SW. Note that in FIG. 13, the sensors 14A, 15A, and 16A are depicted by one block on a representative basis.

The object detection sections 141, 151, and 161 are for detecting the distances and directions from the sensors 14A, 15A, and 16A to an object and detecting the position of the detected object in a three-dimensional coordinate system, and are, for example, infrared depth sensors. Since the relative mounting positions of the sensors 14A, 15A, and 16A relative to the upper swing structure 2 are predetermined by design information or the like, the relative position (relative position in the three-dimensional coordinate system) of the detected object relative to the upper swing structure 2 can be specified from the design information and the detection results of the object detection sections 141, 151, and 161. The object detection sections 141, 151, and 161 output the detection results to the detection position determination sections 142, 152, and 162.

The detection position determination sections 142, 152, and 162 determined whether the detection position of the detected object is in either the first detection range TR or the second detection range SW based on the detection results of the object detection sections 141, 151, and 161, and output the determination result to the controller 20A. The detection position determination sections 142, 152, and 162 have information concerning the first detection range TR and the second detection range SW, and whether the detected object is located in either the first detection range TR or the second detection range SW can be determined by comparing the detection results (position information) of the object detection sections 141, 151, and 161 with the first detection range TR and the second detection range SW.

The detection position determination sections 142, 152, and 162 perform, for example, the process as depicted in the flow chart in FIG. 12. In other words, the detection position determination sections 142, 152, and 162 determines whether or not an object has been detected in the detectable range 40 based on the detection results from the object detection sections 141, 151, and 161. When an object has been detected in the detectable range 40, subsequently, it is determined whether the position at which the object has been detected is in the first detection range TR, or in the second detection range SW or in other range, and when the detection position is in the second detection range SW, Fsw is outputted as a detection flag to the controller 20A. In addition, when the detection position is in the first detection range TR, Ftr is outputted as a detection flag to the controller 20A. Besides, when the detection position is in other range, the process is finished.

The controller 20A has the action limiting determination section 20*b* and the alarm control section 20*c* as functional sections concerning the surrounding monitoring system.

The action limiting determination section 20*b*, upon receiving the detection flag from the sensors 14A, 15A, and 16A, controls the solenoid valves 23*a*, 23*b*, 24*a*, and 24*b* as limiting devices that limit the operation signals outputted from the operation devices 4*b*, 4*c*, 4*d*, and 4*e*, according to the contents of the received detection flag, that is, based on whether the position of the detected object is in either the first detection range TR or the second detection range SW, thereby to limit at least one of travel action of the lower travel structure 1 and swing action of the upper swing structure 2 relative to the lower travel structure 1.

The alarm control section 20*c*, upon receiving the detection flag from the sensors 14A, 15A, and 16A, controls the first buzzer 30 and the second buzzer 31, according to the contents of the received detection flag, that is, according to whether the position of the detected object is in either the first detection range TR or the second detection range SW, thereby to issue different kinds of alarm to the operator.

The characteristics of the present embodiment configured as above will be described.

(1) In the above embodiment, the work machine (for example, the hydraulic excavator 100) provided with the machine body including the lower travel structure 1 and the upper swing structure 2 provided swingably relative to the lower travel structure includes: the operation devices 4*b*, 4*c*, 4*d*, and 4*e* that output operation signals for operating the lower travel structure 1 and the upper swing structure 2 based on operation by an operator; the sensors 14, 15, and 16 that detect an object in the surroundings of the machine body (for example, the lower travel structure 1 and the upper swing structure 2); the safety support device having at least either the limiting devices (for example, the solenoid valves 23*a*, 23*b*, 24*a*, and 24*b*) that limit the action of the machine body or the alarm devices that issues an alarm to the operator; and the controller 20 that controls the safety support device based on the detection signals of the sensors, in which the detection ranges of the sensors include the first detection range TR defined based on the travel performance of the lower travel structure and the second detection range SW defined along the swing rage of the rear end of the upper swing structure.

As a result, the influence of excessive alarm on the working operator can be reduced while enhancing detection accuracy by setting the detection ranges according to the action range of the work machine.

(2) In addition, in the above embodiment, the work machine (for example, in the hydraulic excavator 100) of (1) above, the safety support device has the limiting devices (for example, solenoid valves 23*a*, 23*b*, 24*a*, and 24*b*) that limit the action of the machine body 1B, and the controller 20 limits the travel action of the lower travel structure 1 when the position of the object detected by the sensors 14, 15, and 16 is in the first detection range TR, and controls the limiting devices (for example, the solenoid valves 23*a*, 23*b*, 24*a*, and 24*b*) so as to limit the swing action of the upper swing structure 2 relative to the lower travel structure 1 when the position of the object is in the second detection range.

(3) Besides, in the above embodiment, in the work machine (for example, the hydraulic excavator 100) of (1) above, the sensors 14, 15, and 16 are disposed respectively on the rear side, the left side, and the right side of the upper swing structure 2.

(4) In addition, in the above embodiment, in the work machine (for example, the hydraulic excavator 100) of (1) above, the safety support device has the alarm devices (for example, the first buzzer 30 and the second buzzer 31) that issues an alarm to the operator, and the controller 20 controls the alarm devices so as to issue different kinds of alarm to the operator, according to whether the position of the object detected by the sensors 14, 15, and 16 is in either the first detection range TR or the second detection range SW.

(5) Besides, in the above embodiment, in the work machine (for example, the hydraulic excavator 100), the first detection range TR is set according to a maximum velocity in travel action of the lower travel structure 1.

Additional Remark

Note that the present invention is not limited to the above embodiments, and include various modifications and combinations within such ranges as not to depart from the gist of the invention. In addition, the present invention is not limited to the one that includes all the configurations described in the above embodiments, and includes those in which part of the configurations is deleted. Besides, the aforementioned configurations, functions, and the like may be realized partly or wholly by, for example, designing by integrated circuits or the like. In addition, the aforementioned configurations, functions, and the like may be realized on a software basis by a processor interpreting and executing programs for realizing the respective functions.

DESCRIPTION OF REFERENCE SYMBOLS

1: Lower travel structure

1*a*, 1*b*: Travel hydraulic motor

1*c*, 1*d*: Crawler frame
1*e*, 1*f*: Crawler
2: Upper swing structure
3: Front work implement
3*a*: Boom
3*b*: Arm
3*c*: Bucket
3*d*: Boom cylinder
3*e*: Arm cylinder
3*f*: Bucket cylinder
4: Cabin
4*a*: Seat
4*b*, 4*c*, 4*d*, 4*e*: Operation device
4*f*: Gate lock lever
4*g*: Monitor
10: Swing hydraulic motor
14, 14A: Right side sensor
15, 15A: Rear side sensor
16, 16A: Left side sensor
20, 20A: Controller
20*a*, 142, 152, 162: Detection position determination section
20*b*: Action limiting determination section
20*c*: Alarm control section
23*a*, 23*b*, 24*a*, 24*b*: Solenoid valve
25: Engine
26: Hydraulic pump
26*a*: Delivery line
27: Pilot pump
27*a*: Delivery line
27*b*: Lock valve
28: Directional control valve
28*a*: Center bypass line
30: First buzzer
31: Second buzzer
29: Hydraulic tank
29*a*: Tank line
100: Hydraulic excavator
TR: First detection range
SW: Second detection range
141, 151, 161: Object detection section

The invention claimed is:

1. A work machine provided with a machine body including a lower travel structure and an upper swing structure provided swingably relative to the lower travel structure, the work machine comprising:

an operation device that outputs, based on operation by an operator, operation signals for operating the lower travel structure and the upper swing structure;

a sensor that detects an object in surroundings of the machine body;

a safety support device having at least one of a limiting device that limits action of the machine body and an alarm device that gives an alarm to the operator; and a controller that controls the safety support device based on a detection signal from the sensor, wherein a detection range of the sensor includes a first detection range defined predetermined based on travel performance of the lower travel structure and a second detection range predetermined at a position on the upper swing structure side of the first detection range and spaced outward from a rear end of the upper swing structure based on swing range of the upper swing structure, and the controller controls the safety support device based on whether a detection position of the object sensed by the sensor is in either the first detection range or the second detection range.

2. The work machine according to claim 1, wherein the safety support device has the limiting device that limits action of the machine body, and the controller controls the limiting device so as to limit travel operation of the lower travel structure without limiting swing operation of the upper swing structure relative to the lower travel structure when the position of the object detected by the sensor is in the first detection range and to limit swing operation of the upper swing structure relative to the lower travel structure without limiting travel operation of the lower travel structure when the position of the object is in the second detection range.

3. The work machine according to claim 1, wherein the sensors are disposed respectively on a rear side, a left side, and a right side of the upper swing structure; and a boundary that is the periphery of the first detection range is set by a left boundary that extends in the front-rear direction from the left side to rear side so as to be along the left side surface of the upper swing structure, a rear boundary that extends in the left-right direction behind the upper swing structure, and a right boundary that extends in the front-rear direction from the right side to rear side so as to be along the right side surface of the upper swing.

4. The work machine according to claim 1, wherein the safety support device has the alarm device that issues an alarm to the operator, and the controller controls the alarm device to issue different kinds of alarm to the operator according to whether the position of the object detected by the sensor is in either the first detection range or the second detection range.

5. The work machine according to claim 1, wherein the first detection range is set according to a maximum velocity of travel action of the lower travel structure.

* * * * *